US006589077B1

(12) United States Patent
Wu

(10) Patent No.: US 6,589,077 B1
(45) Date of Patent: Jul. 8, 2003

(54) ELECTRICAL CONNECTOR WITH SELF-RETAINING BOARD LOCKS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/159,458

(22) Filed: May 31, 2002

(51) Int. Cl.[7] ..... H01R 13/60
(52) U.S. Cl. ..... 439/567; 439/570
(58) Field of Search ..... 439/567, 570, 439/571, 572

(56) References Cited

U.S. PATENT DOCUMENTS 5,171,165 A * 12/1992 Hwang ..... 439/567
5,176,349 A * 1/1993 Bendorf ..... 248/220.22
5,184,963 A * 2/1993 Ishikawa ..... 439/79
5,213,515 A * 5/1993 Ishikawa et al. ..... 439/79
5,228,870 A * 7/1993 Gorenc et al. ..... 439/567
5,632,649 A * 5/1997 Spangler ..... 439/567
5,827,089 A 10/1998 Beck
5,863,222 A 1/1999 Kinsey, Jr. et al.
5,957,722 A * 9/1999 Pan et al. ..... 439/567
6,027,371 A * 2/2000 Lin et al. ..... 439/567
6,106,331 A * 8/2000 Kurotori et al. ..... 439/567
6,132,247 A * 10/2000 Liou et al. ..... 439/567
6,152,765 A * 11/2000 Tang et al. ..... 439/567
6,454,599 B1 * 9/2002 Wu ..... 439/567

OTHER PUBLICATIONS

Introducing Serial ATA White Paper.

* cited by examiner

*Primary Examiner*—Tulsidas Patel
*Assistant Examiner*—Hae Moon Hyeon
(74) *Attorney, Agent, or Firm*—WeiTe Chung

(57) ABSTRACT

An electrical connector (1)includes an insulative housing (2), a number of terminals (3)received in the insulative housing and a pair of board locks (4). The insulative housing defines a slit (212)and a pair of channels (213, 214) communicating with the slit. The board lock includes a main body (40)received in the slit and a pair of downward legs (41)for engaging with a mating printed circuit board. The main body includes a barb (401)for engaging with a bottom wall (215)of the slit and a pair of bent tabs (402, 403)for engaging in corresponding channels.

8 Claims, 6 Drawing Sheets

ELECTRICAL CONNECTOR WITH SELF-RETAINING BOARD LOCKS

BACKGROUND OF THE INVENTION

1. Field of the Invention

The present invention relates to an electrical connector, and particularly to an electrical connector able to be securely attached to a printed circuit board (PCB).

2. Description of Prior Art

As a next generation personal computer (PC) storage interface, Serial ATA will replace the Ultra ATA/100 interface used to connect most PCs to their primary storage, which is projected to become a bottleneck in the future. The Serial ATA connector is equipped with a board retaining device so that it can securely assembled to a printed circuit board (PCB).

As it is known that there are numerous ways to configure the board retaining device. For example, the electrical connector may be provided with mounting ears having bores for accepting threaded mounting bolts which extend through corresponding apertures of the PCB and are secured by nuts on a bottom side of the board.

In addition, U.S. Pat. Nos. 5,184,963 and 5,213,515 disclose a top loaded board lock for mounting an electrical connector on a PCB. The electrical connector includes a housing and a pair of board locks. The housing includes a board mounting surface and an opposite surface. The board locks are inserted into flanges or other portion of the housing from the opposite surface. When mounting such electrical connectors to a PCB, it is necessary to use a tool to apply force directly to the board locks thereby inserting the board locks into the circuit board apertures so that the board locks will not move backwardly out of the connector housing. Such an operation is inconvenient. It is desirable, therefore, to have a board lock that is self-retained in the housing.

One such approach is disclosed in U.S. Pat. No. 5,228,870 wherein a first portion of a board lock is captured in a slit of the housing and a second portion of the board lock is inserted into an aperture of the PCB. The portions are provided with barbs. A portion of the housing above the slit provides a backing surface for the board lock during mounting the electrical connector on the PCB.

U.S. Pat. No. 5,176,349 discloses a further approach in which the housing includes an integrally molded post for being received in an aperture of a PCB. The post has a slit in which a resilient retaining member can be inserted from a direction that is transverse to the longitudinal axis of the post. The housing provides a backing surface for the retaining member when the connector or other component is mounted on the PCB. A disadvantage of this type of retaining member is that a core pin is required to form the housing and post configuration, thereby increasing the manufacturing cost of the connector. The assembly of the connector requires additional steps since the terminal members and the retaining member are inserted into the housing along different directions.

U.S. Pat. Nos. 5,863,222 and 5,827,089 disclose a retaining member which is inserted into an insulative housing along a same direction as terminals thereof. However, the retaining member has no self-retaining means and may be separated from the connector.

Hence, an improved electrical connector is required to overcome the disadvantages of the conventional electrical connector.

SUMMARY OF THE INVENTION

Accordingly, a first object of the present invention is to provide an electrical connector having improved board locks for securely mounting the electrical connector on a PCB.

A second object of the present invention is to provide an electrical connector having improved board locks which are convenient for assembly.

In order to achieve the objects above-mentioned, an electrical connector comprises an insulative housing, a plurality of terminals received in the insulative housing and a pair of board locks. The insulative housing comprises a crossbeam and two arms extending perpendicularly from opposite ends of the crossbeam. Each of the arms defines a slit for receiving the board lock and a pair of channels communicating with the slit. The board lock comprises a main body received in the slit and a pair of downward extending legs for engaging with a mating PCB. The main body comprises a barb for engaging with a bottom wall of the slit and a pair of bent tabs engaging in the channels; therefore, the board locks are securely self-retained in the insulative housing. In addition, the board locks are assembled in the insulative housing from a rear-to-front direction which is the same as the terminals, therefore, the board locks is convenient for automated assembly.

Other objects, advantages and novel features of the invention will become more apparent from the following detailed description when taken in conjunction with the accompanying drawings.

DETAILED DESCRIPTION OF THE INVENTION

Figure 1:
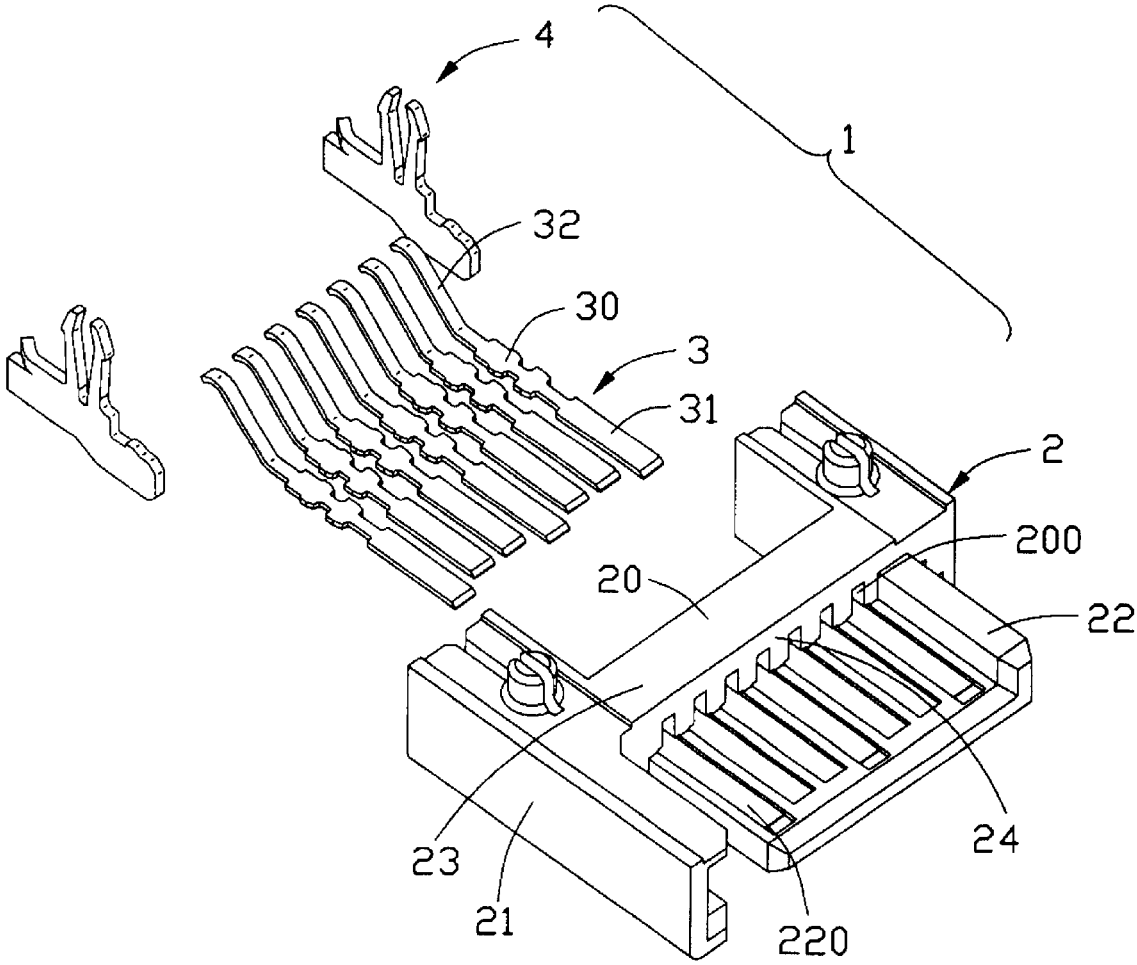
FIG. 1 is an exploded, perspective bottom view of an electrical connector in accordance with the present invention.

Reference will now be made to the drawing figures to describe the present invention in detail.

Figure 2:
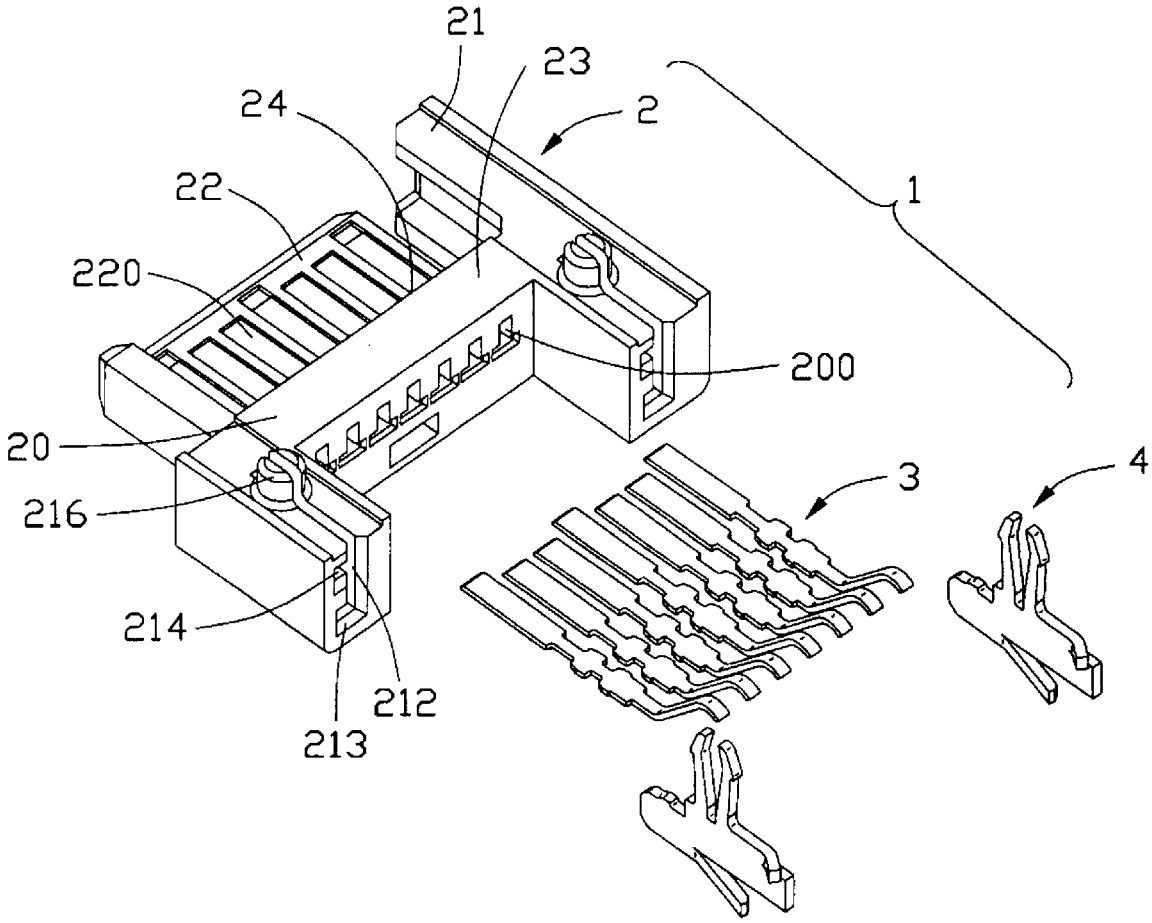
FIG. 2 is a view similar to FIG. 1 from a different aspect.

Referring to FIGS. 1 and 2, an electrical connector 1, such as a serial ATA connector 1, in accordance with the present invention comprises an insulative housing 2, a plurality of terminals 3 received in the insulative housing 2 and a pair of board locks 4 assembled in the insulative housing 2.

The insulative housing 2 defines a mounting surface 23 for mounting onto a PCB 5 (FIG. 5) and a front mating surface 24 for engaging with a mating plug connector. The insulative housing 2 comprises a crossbeam 20, two arms 21 extending perpendicularly from opposite ends of the crossbeam 20 and a lower wall 22 extending forwardly from the front mating surface 24 of the crossbeam 20. One arm 21 only extends rearwards from the crossbeam 20, and the other extends both forwards and rearwards therefrom. The crossbeam 20 defines a plurality of longitudinal passageways 200 therethrough. The lower wall 22 defines a plurality of longitudinal apertures 220 in a top surface thereof, each communicating with a corresponding passageway 200 in the crossbeam 20.

Each of the arms 21 comprises a post 216 extending downwardly and defines a longitudinal slit 212. In addition, the arm 21 further defines an upper longitudinal channel 213 communicating with the slit 212 and a lower longitudinal channel 214 communicating with the slit 212. A front wall 217 is provided at a front end of the upper longitudinal channel 213 (referring to FIG. 6).

Each terminal 3 comprises a mounting portion 30, a contacting portion 31 extending forwardly from a front end of the mounting portion 30 and a curved solder tail 32 extending rearwardly from a rear end of the mounting portion 30.

Figure 3:
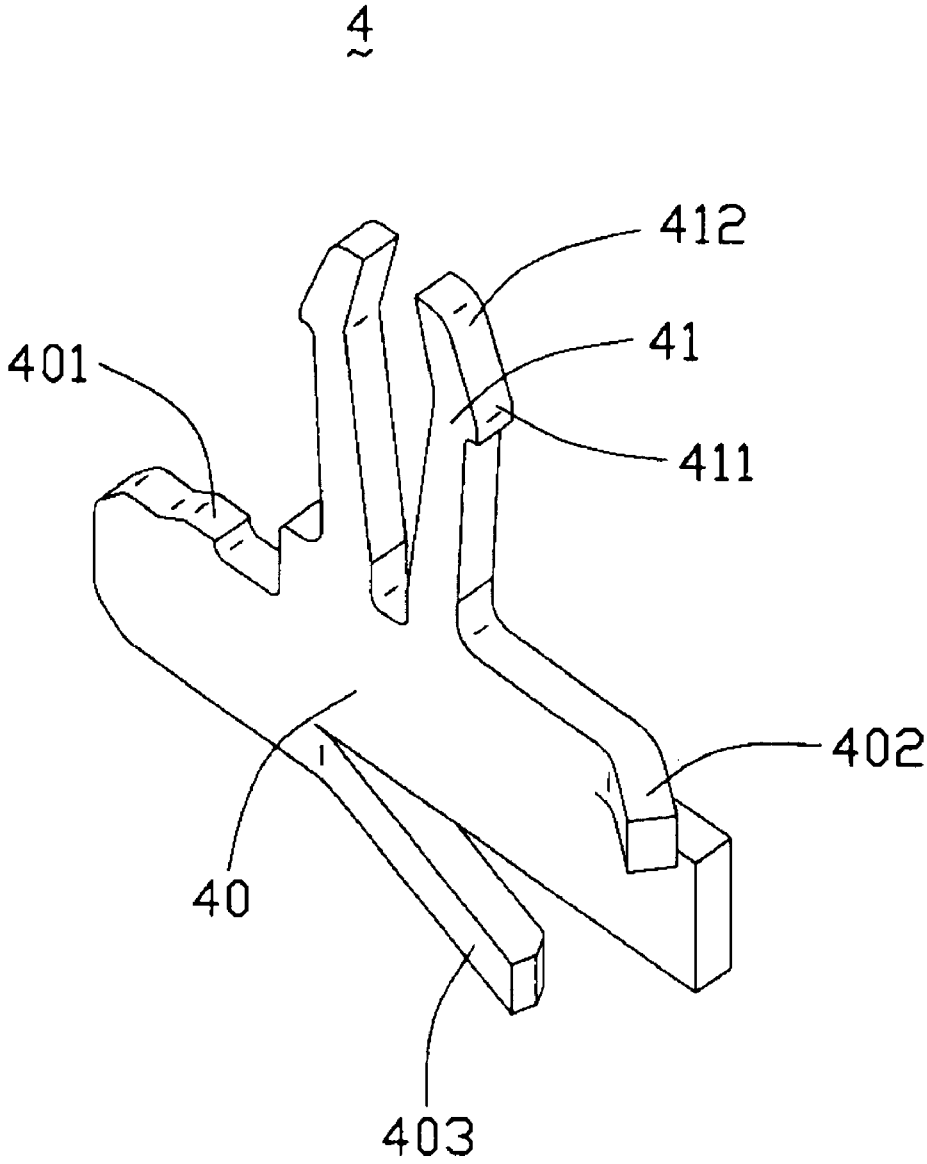
FIG. 3 is a perspective bottom view of a board lock of the electrical connector of the present invention.

Referring to FIG. 3, each board lock 4 comprises a main body 40 and a pair of legs 41 extending downwardly from the main body 40. The main body 40 comprises a barb 401 extending downwardly from a bottom of a front end thereof, a lower bent tab 402 extending sideward from a bottom of a rear end and an upper bent tab 403 extending sideward from a top of a middle portion thereof. Each of the legs 41 comprises a protrusion 411 extending outwardly and a slanted surface 412 from the protrusion 411 to a bottom end thereof for conveniently engaging with a hole 50 of the PCB 5 (shown in FIG. 5).

Figure 4:
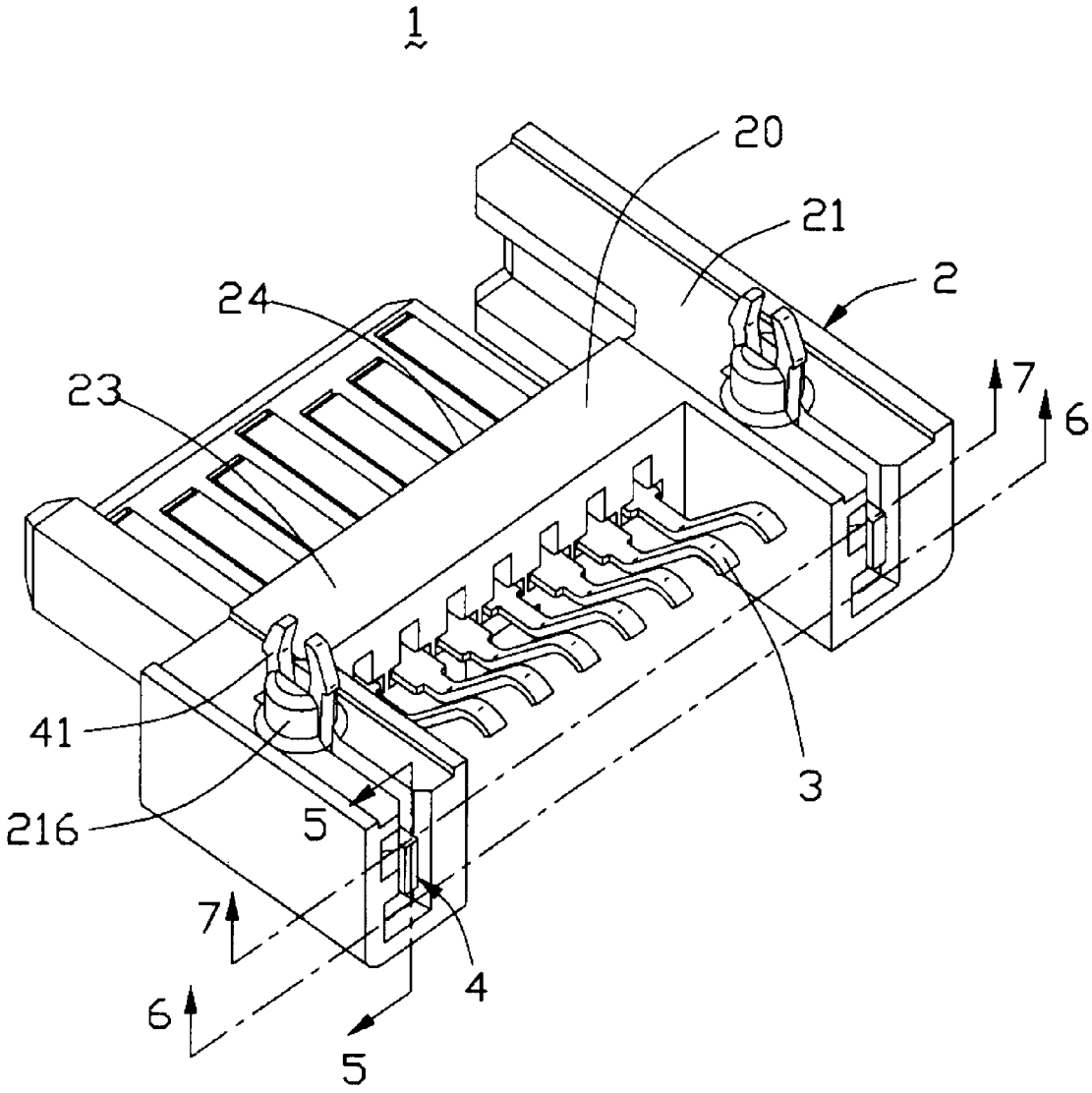
FIG. 4 is an assembled view of FIG. 2.

Referring to FIG. 4, in assembly, the terminals 3 are assembled in the insulative housing 2 with the mounting portions 30 extending in the passageways 200 of the crossbeam 20 and the contacting portions 31 being received in corresponding apertures 221 of the lower wall 22. The mounting portions 30 have an interferential engagement with the crossbeam 20 thereby securing the terminals 3 to the housing 2. The board locks 4 are assembled in the insulative housing 2 with the legs 41 extending downward beyond the post 216. The main bodies 40 are received in corresponding cavities 212 of corresponding arms 21 The barbs 401 each engage with a bottom wall 215 of a corresponding arm 21 located below the slit 212 thereof. The lower bent tabs 402 are received in the lower longitudinal channels 214 and the upper bent tabs 403 are received in the upper longitudinal channels 213.

During the assembly of the electrical connector 1 onto the PCB 5, the posts 216 engage in the holes 50 of the PCB 5 to thereby achieve an accurate position of the electrical connector 1 on the PCB 5. The legs 41 engage with the PCB 5 for securely mounting the electrical connector 1 on the PCB 5.

In an alternative embodiment of the present invention, the electrical connector 1 only has the board locks 4 and does not have the posts 216.

Figure 5:
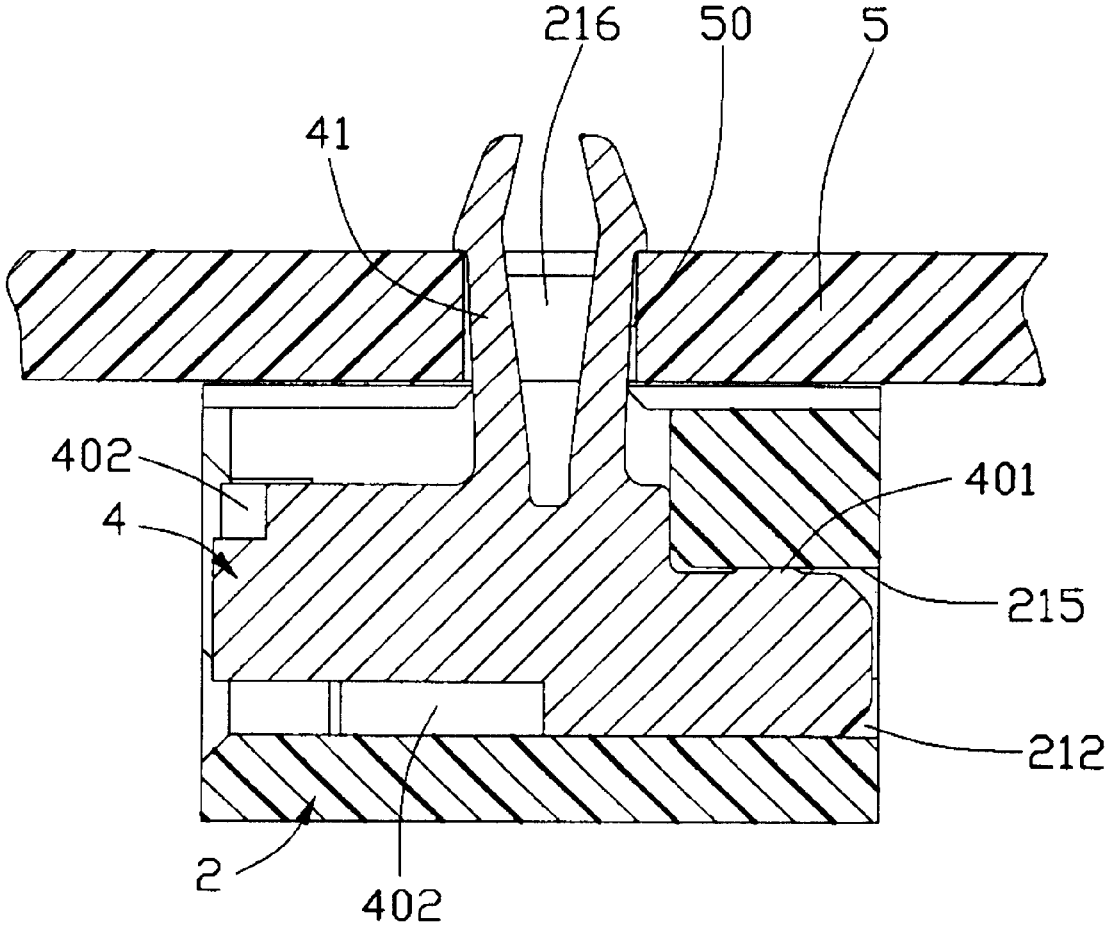
FIG. 5 is a cross-sectional view taken along line 5—5 of FIG. 4.
Figure 6:
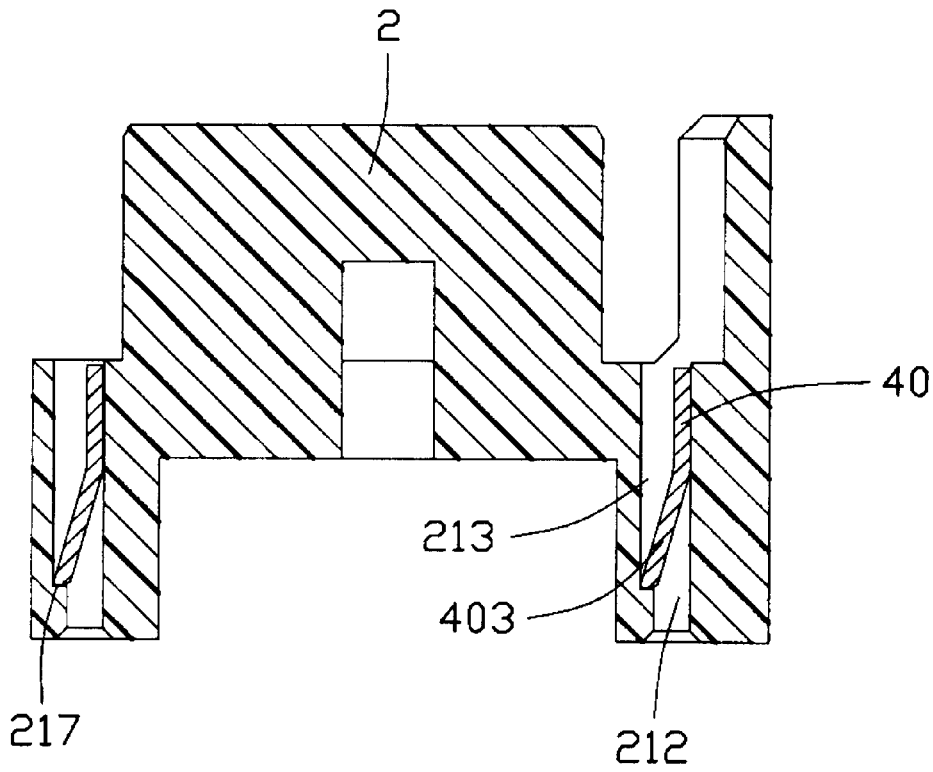
FIG. 6 is a cross-sectional view taken along line 6—6 of FIG. 4.
Figure 7:
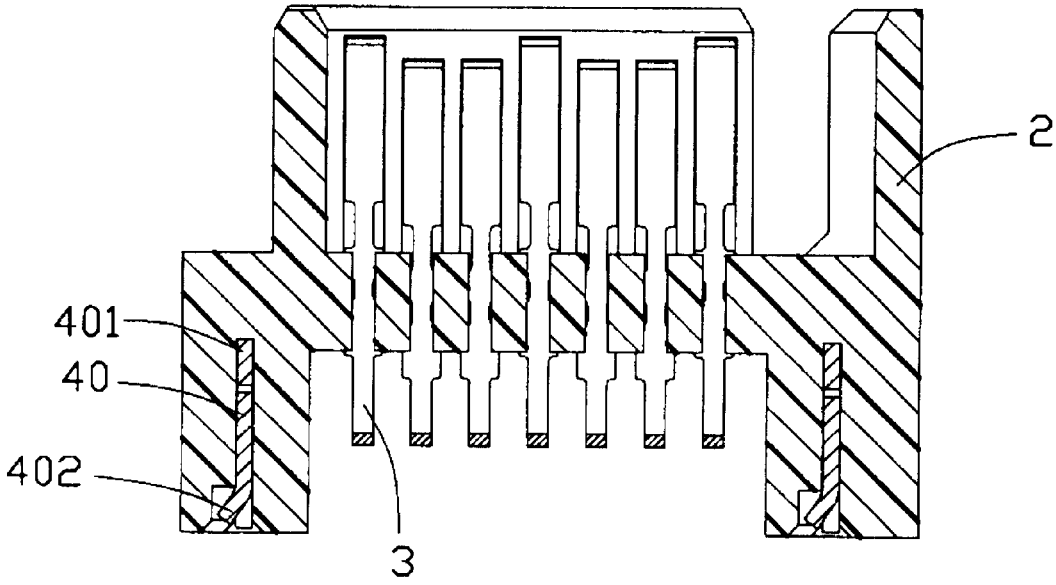
FIG. 7 is a cross-sectional view taken along line 7—7 of FIG. 4.

Referring to FIGS. 5–7, the barb 401 engage with the bottom wall 215 of the arms 21 thereby preventing the board lock 4 from moving backwardly. The lower bent tabs 402 are received in the lower longitudinal channels 214 and abut against walls (not labeled) of the arms 21 besides the lower longitudinal channels 214. In addition, the upper bent bars 403 are received in the upper longitudinal channels 213. A front end of each of the upper bent bars 403 presses against a corresponding front wall 217; therefore the board locks 4 are protected from moving backwardly. In addition, since the board locks 4 and the terminals 3 are assembled into the insulative housing 2 along a same direction; in assembly, the terminals 3 and board locks 4 can be assembled into the insulative housing 2 by one assembling step, which can simplify the assembly procedure and lower the manufacturing cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted to a printed circuit board (PCB), comprising:

an insulative housing defining a mounting surface and comprising a crossbeam, two arms extending from two opposite ends of the crossbeam and a post extending downwardly from the mounting surface, and at least one of the arms defining a receiving slit therein;

a plurality of terminals assembled to the crossbeam of the insulative housing; and a retention member assembled to at least one of the arms, the retention member comprising a main body retained in the receiving slit of the at least one of the arm, a retention section extending downwards beyond a bottom surface of the post adapted for attaching the electrical connector to the PCB, and a plurality of bent tabs, the bent tabs comprising an upper tab and a lower tab, the upper tab extending sideward from a top of a middle portion of the main body, the lower tab extending sideward from a bottom of a rear end of the main body.

2. The electrical connector as described in claim 1, wherein the at least one of the arms of the insulative housing defining an upper and a lower receiving channels communicating with the receiving slit, and wherein the upper and lower tabs are received in the upper and lower receiving channels.

3. An electrical connector comprising:

an insulative housing defining a receiving slit and a plurality of receiving channels communicating with the receiving slit;

a plurality of terminals being assembled in the insulative housing; and a retention member comprising a main body received in the receiving slit, a pair of legs extending beyond the insulative housing and a plurality of bent tabs extending sideward from a middle portion of the main body and engaging in corresponding receiving channels.

4. The electrical connector described in claim 3, wherein the terminals and the retention member are inserted into the insulative housing along a same direction.

5. The electrical connector described in claim 3, wherein the receiving channels comprise an upper receiving channel and a lower receiving channel, and the bent tabs comprise an upper tab and a lower tab respectively received in the upper and lower receiving channels.

6. The electrical connector as described in claim 5, wherein the insulative housing provides a front wall in front of the receiving channel engaged by the upper tab.

7. An electrical connector assembly comprising:

a printed circuit board defining opposite upper and bottom surface thereof and a through hole therein;

an insulative housing mounted on the upper surface of the printed circuit board and defining a mounting surface with a post integrally extending downwardly therefrom, said post extending into the through hole while not beyond the bottom surface of the printed circuit board;

an elongated slit forwardly extending from a rear face of the housing and through said mounting surface including said post vertically;

at least a longitudinal channel extending from the rear face of the housing in communication with the slit; and a retention member inserted into the slit from the rear face, said retention member including a pair of legs downwardly extending along and further beyond the post under a condition that said pair of legs extend through the through hole with protrusions thereof engaged with the bottom surface of the printed circuit board, and at least a tab engaged within said at least a channel; wherein said mounting surface is different from said rear face.

8. The assembly as described in claim 7, wherein said mounting surface and said rear face are perpendicular to each other.

* * * * *